US011341899B2

(12) United States Patent
Nie

(10) Patent No.: US 11,341,899 B2
(45) Date of Patent: May 24, 2022

(54) PIXEL DRIVING CIRCUIT AND DISPLAY DEVICE

(71) Applicant: SHENZHEN CHINA STAR OPTOELECTRONICS SEMICONDUCTOR DISPLAY TECHNOLOGY CO., LTD, Shenzhen (CN)

(72) Inventor: Chenglei Nie, Shenzhen (CN)

( * ) Notice: Subject to any disclaimer, the term of this patent is extended or adjusted under 35 U.S.C. 154(b) by 303 days.

(21) Appl. No.: 16/617,520

(22) PCT Filed: Sep. 17, 2019

(86) PCT No.: PCT/CN2019/106107
§ 371 (c)(1),
(2) Date: Nov. 27, 2019

(87) PCT Pub. No.: WO2021/017118
PCT Pub. Date: Feb. 4, 2021

(65) Prior Publication Data

US 2021/0335216 A1 Oct. 28, 2021

(30) Foreign Application Priority Data

Jul. 26, 2019 (CN) ..... 201910680801.X

(51) Int. Cl.
*G09G 3/32* (2016.01)

(52) U.S. Cl.
CPC ..... *G09G 3/32* (2013.01); *G09G 2310/06* (2013.01); *G09G 2320/064* (2013.01)

(58) Field of Classification Search
CPC ..... G09G 3/32; G09G 3/325; G09G 3/3233; G09G 3/3258; G09G 3/3266; G09G 3/3275; G09G 2310/06; G09G 2320/064; G09G 2320/0233; G09G 3/30; G09G 2300/0804
See application file for complete search history.

(56) References Cited

U.S. PATENT DOCUMENTS

| | | | | |
|---|---|---|---|---|
| 9,881,549 | B2 * | 1/2018 | Li | G09G 3/3233 |
| 10,510,296 | B2 * | 12/2019 | Chen | H01L 27/3244 |
| 10,916,599 | B2 * | 2/2021 | Wang | H01L 27/3262 |
| 11,170,711 | B1 * | 11/2021 | Nie | G09G 3/3225 |
| 2006/0145962 | A1 * | 7/2006 | Jeon | G09G 3/3291 345/76 |
| 2009/0109208 | A1 | 4/2009 | Yamashita et al. | |

(Continued)

FOREIGN PATENT DOCUMENTS

| | | | |
|---|---|---|---|
| CN | 101419776 | A | 4/2009 |
| CN | 101540130 | A | 9/2009 |

(Continued)

*Primary Examiner* — Vijay Shankar
(74) *Attorney, Agent, or Firm* — JMB Davis Ben-David

(57) ABSTRACT

A pixel driving circuit and a display device are provided. The pixel driving circuit includes an addressing transistor, a driving transistor, a storage capacitor, and a plurality of pixel units connected in parallel. The pixel unit includes a digital signal controller. The digital signal controller is series connected to lighting units. The gate of the addressing transistor receives a scan signal, the digital signal controller provides a digital signal, the scan signal and the digital signal makes the lighting units periodically generate lights such that a predetermined frame is displayed.

16 Claims, 2 Drawing Sheets

(56) References Cited

U.S. PATENT DOCUMENTS

| | | | | |
|---|---|---|---|---|
| 2014/0218420 | A1 | 8/2014 | Yamashita | |
| 2015/0332628 | A1 | 11/2015 | Ren et al. | |
| 2017/0018223 | A1* | 1/2017 | Li | G09G 3/3258 |
| 2020/0212137 | A1* | 7/2020 | Wang | G09G 3/325 |

FOREIGN PATENT DOCUMENTS

| | | | |
|---|---|---|---|
| CN | 103489401 | A | 1/2014 |
| CN | 104752468 | A | 7/2015 |
| CN | 105185321 | A | 12/2015 |
| CN | 107170408 | A | 9/2017 |
| CN | 107221557 | A | 9/2017 |

* cited by examiner

PIXEL DRIVING CIRCUIT AND DISPLAY DEVICE

CROSS-REFERENCE TO RELATED APPLICATIONS

This is the U.S. National Stage of International Patent Application No. PCT/CN2019/106107, filed Sep. 17, 2019, which in turn claims the benefit of Chinese Patent Application No. 201910680801.X, filed Jul. 26, 2019.

FIELD OF THE INVENTION

The present invention relates to a display field, and more particularly to a pixel driving circuit and a display device.

BACKGROUND

In the active matrix display circuit, the pixel driving circuit could be categorized into two types of circuits, the time-division multiplexing circuit and the spatial multiplexing circuit.

The time-division multiplexing circuit is mainly implemented with a pulse width modulation (PWM) circuit. The PWM circuit could divide the display time of a row into multiple time periods and realize different grey levels by switching black/white in the time periods. However, the driving TFT is working in the linear region when the PWM circuit is working, this makes the switching frequency too high and a current driving IC cannot support such a high switching frequency. In addition, the spatial multiplexing circuit could divide the display region into multiple regions and realize different grey levels by displaying black/white in the multiple regions. This mechanism requires a larger display region.

From the above, the conventional pixel driving circuit has issues of high switching frequency or larger display region.

SUMMARY

One objective of an embodiment of the present invention is to provide a pixel driving circuit and a display, which utilizes the spatial multiplexing mechanism with the time-division multiplexing mechanism to solve the above-mentioned issues of high switching frequency or larger display region.

According to an embodiment of the present invention, a pixel driving circuit is provided. The pixel driving circuit comprises: an addressing transistor; a driving transistor; a storage capacitor; and a plurality of pixel units connected in parallel. A drain of the addressing transistor is electrically connected to a gate of the driving transistor. A first end of the storage capacitor is connected to the gate of the driving transistor and a second end of the storage capacitor is connected to a drain of the driving transistor. The pixel units are connected to the drain of the driving transistor, the pixel units comprise at least one digital signal controller, and the digital signal controller is series connected to a plurality of lighting units. The gate of the addressing transistor receives a scan signal, the digital signal controller provides a digital signal, the scan signal and the digital signal makes the lighting units periodically generate lights such that a predetermined frame is displayed.

Optionally, a source of the driving transistor receives a positive power voltage, a cathode of the lighting units receives a negative power voltage, the scan signal, the positive power voltage and the negative power voltage together act on the driving transistor to form a current signal of the drain of the driving transistor. The digital signal controller provides the digital signal having a predetermined addressing period, the digital signal and the current signal are both transferred to an anode of the lighting units such that the current signal has a predetermined display period and the lighting units generates light in the predetermined display period. The predetermined addressing period and the predetermined display period constitute a predetermined period of the predetermined frame such that the lighting units constitute the predetermined frame.

Optionally, when the scan signal corresponds to a high impulse, the addressing transistor is turned on, the gate of the addressing gate receives the scan signal, and the storage capacitor stores the scan signal and transform the scan signal into a corresponding current signal. When the scan signal corresponds to a low impulse, the addressing transistor is turned off, the storage capacitor provides the current signal to the gate of the driving transistor. When a current value of the current signal reaches a current threshold of the driving transistor, the driving transistor is turned on and the lighting units generate light.

Optionally, the scan signal, the digital signal, and the current signal are superposed to indicate the predetermined addressing period and the predetermined display period in the predetermined period. In the predetermined addressing period, the scan signal is a high voltage impulse, the current signal corresponds to a low voltage level and the digital signal corresponds to a logic high level. In the predetermined display period, the scan signal is a low voltage impulse, the current signal corresponds to a high voltage level and the digital signal corresponds to a logic low level.

Optionally, in one of the pixel units, the predetermined display period is double of the predetermined addressing period in one predetermined period.

Optionally, the pixel units comprise a first pixel unit and a second pixel unit, the first pixel unit comprises a first digital signal controller and a lighting unit, and the first digital signal controller is electrically connected to an anode of the lighting unit. The second pixel unit comprises a second digital signal controller and two lighting unit connected in parallel, the second digital signal controller is electrically connected to anodes of the two lighting units connected in parallel to make a luminance of the second pixel unit be double of a luminance of the first pixel unit.

Optionally, the pixel units further comprise a third pixel unit, connected to the second pixel unit in parallel. The third pixel unit comprises a third digital signal controller electrically connected to anodes of a predetermined number of lighting units. The predetermined number of lighting units are connected in parallel. The predetermined number is an odd number times of a number of the lighting units of the second pixel unit such that a luminance of the third pixel unit is the odd number times of the luminance of the second pixel unit.

Optionally, the pixel driving circuit further comprises a plurality of vertical data lines and a plurality of horizontal scan lines. The data lines provide a data signal to a source of the addressing transistor, and the scan line provides the scan signal to the gate of the addressing transistor such that the drain of the addressing transistor provides a current signal to the storage capacitor.

Optionally, the digital signal controller is implemented with a low temperature poly silicon (LTPS) TFT, an oxide-semiconductor TFT, or an amorphous silicon TFT.

According to an embodiment of the present invention, a display device is provided. The display device comprises a pixel driving circuit. The pixel driving circuit comprises: an addressing transistor; a driving transistor; a storage capacitor; and a plurality of pixel units connected in parallel. A drain of the addressing transistor is electrically connected to a gate of the driving transistor. A first end of the storage capacitor is connected to the gate of the driving transistor and a second end of the storage capacitor is connected to a drain of the driving transistor. The pixel units are connected to the drain of the driving transistor, the pixel units comprise at least one digital signal controller, and the digital signal controller is series connected to a plurality of lighting units. The gate of the addressing transistor receives a scan signal, the digital signal controller provides a digital signal, the scan signal and the digital signal makes the lighting units periodically generate lights such that a predetermined frame is displayed.

Optionally, a source of the driving transistor receives a positive power voltage, a cathode of the lighting units receives a negative power voltage, the scan signal, the positive power voltage and the negative power voltage together act on the driving transistor to form a current signal of the drain of the driving transistor. The digital signal controller provides the digital signal having a predetermined addressing period, the digital signal and the current signal are both transferred to an anode of the lighting units such that the current signal has a predetermined display period and the lighting units generates light in the predetermined display period. The predetermined addressing period and the predetermined display period constitute a predetermined period of the predetermined frame such that the lighting units constitute the predetermined frame.

Optionally, when the scan signal corresponds to a high impulse, the addressing transistor is turned on, the gate of the addressing gate receives the scan signal, and the storage capacitor stores the scan signal and transform the scan signal into a corresponding current signal. When the scan signal corresponds to a low impulse, the addressing transistor is turned off, the storage capacitor provides the current signal to the gate of the driving transistor. When a current value of the current signal reaches a current threshold of the driving transistor, the driving transistor is turned on and the lighting units generate light.

Optionally, the scan signal, the digital signal, and the current signal are superposed to indicate the predetermined addressing period and the predetermined display period in the predetermined period. In the predetermined addressing period, the scan signal is a high voltage impulse, the current signal corresponds to a low voltage level and the digital signal corresponds to a logic high level. In the predetermined display period, the scan signal is a low voltage impulse, the current signal corresponds to a high voltage level and the digital signal corresponds to a logic low level.

Optionally, in one of the pixel units, the predetermined display period is double of the predetermined addressing period in one predetermined period.

Optionally, the pixel units comprise a first pixel unit and a second pixel unit, the first pixel unit comprises a first digital signal controller and a lighting unit, and the first digital signal controller is electrically connected to an anode of the lighting unit. The second pixel unit comprises a second digital signal controller and two lighting unit connected in parallel, the second digital signal controller is electrically connected to anodes of the two lighting units connected in parallel to make a luminance of the second pixel unit be double of a luminance of the first pixel unit.

Optionally, the pixel units further comprise a third pixel unit, connected to the second pixel unit in parallel. The third pixel unit comprises a third digital signal controller electrically connected to anodes of a predetermined number of lighting units. The predetermined number of lighting units are connected in parallel. The predetermined number is an odd number times of a number of the lighting units of the second pixel unit such that a luminance of the third pixel unit is the odd number times of the luminance of the second pixel unit.

Optionally, the pixel driving circuit further comprises a plurality of vertical data lines and a plurality of horizontal scan lines. The data lines provide a data signal to a source of the addressing transistor, and the scan line provides the scan signal to the gate of the addressing transistor such that the drain of the addressing transistor provides a current signal to the storage capacitor.

Optionally, the digital signal controller is implemented with a low temperature poly silicon (LTPS) TFT, an oxide-semiconductor TFT, or an amorphous silicon TFT.

In contrast to the conventional art, an embodiment of the present invention adds one or more digital signal controllers to control the lighting units to periodically generate light such that the spatial multiplexing mechanism and the time-division multiplexing mechanism are both used. This solves the issues of high switching frequency or larger display region.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION OF PREFERRED EMBODIMENTS

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

Figure 1:
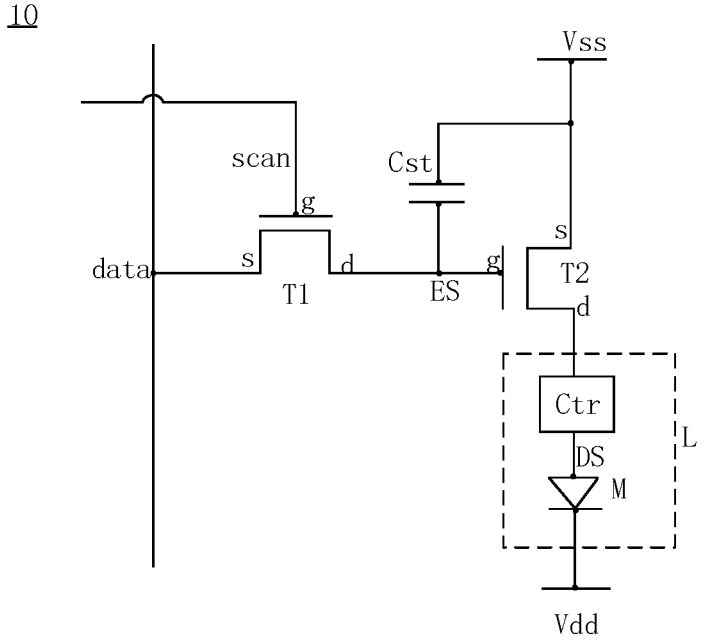
FIG. 1 is a diagram of a pixel driving circuit according to an embodiment of the present invention.
Figure 3:
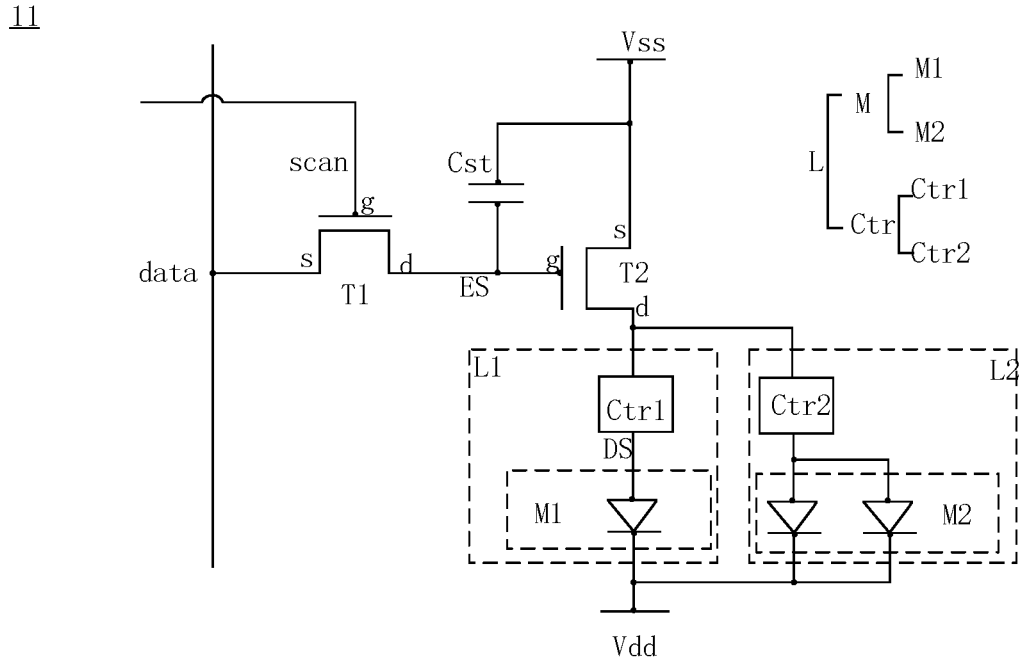
FIG. 3 is a diagram of a pixel driving circuit according to another embodiment of the present invention.
Figure 4:
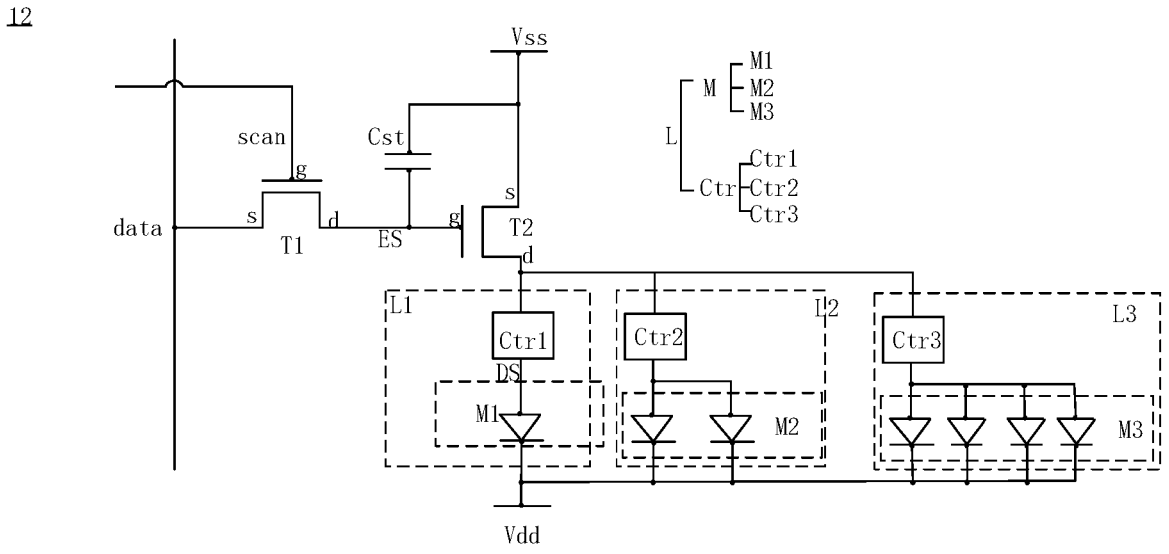
FIG. 4 is a diagram of a pixel driving circuit according to another embodiment of the present invention.

Please refer to FIG. 1, FIG. 3, and FIG. 4, which depict a pixel driving circuit according to embodiments of the present invention. A pixel driving circuit 10 is provided. The pixel driving circuit 10 comprises an addressing transistor T1, a driving transistor T2, a storage capacitor Cst and multiple pixel units L connected in parallel. The drain d of the addressing transistor T1 is electrically connected to the gate g of the driving transistor T2. The first end of the storage capacitor Cst is connected to the gate g of the driving transistor T2 and the second end of the storage capacitor is connected to the drain of the driving transistor T2. The pixel unit L is connected to the drain d of the driving transistor T2. The pixel unit L comprises at least one digital signal controller Ctr. The digital signal controller Ctr and the lighting unit M is connected in parallel.

The gate of the addressing transistor T1 receives a scan signal. The digital signal controller Ctr provide a digital signal DS. The scan signal scan and the digital signal DS make the lighting unit M periodically generate light to display a predetermined frame.

The source s of the driving transistor T2 receives a power positive voltage Vss. The cathode of the lighting unit M receives a power negative voltage Vdd. The scan signal scan, the power positive voltage Vss and the power negative voltage Vdd work together on the driving transistor T2 to form a current signal ES of the drain d of the driving transistor T2.

Figure 2:
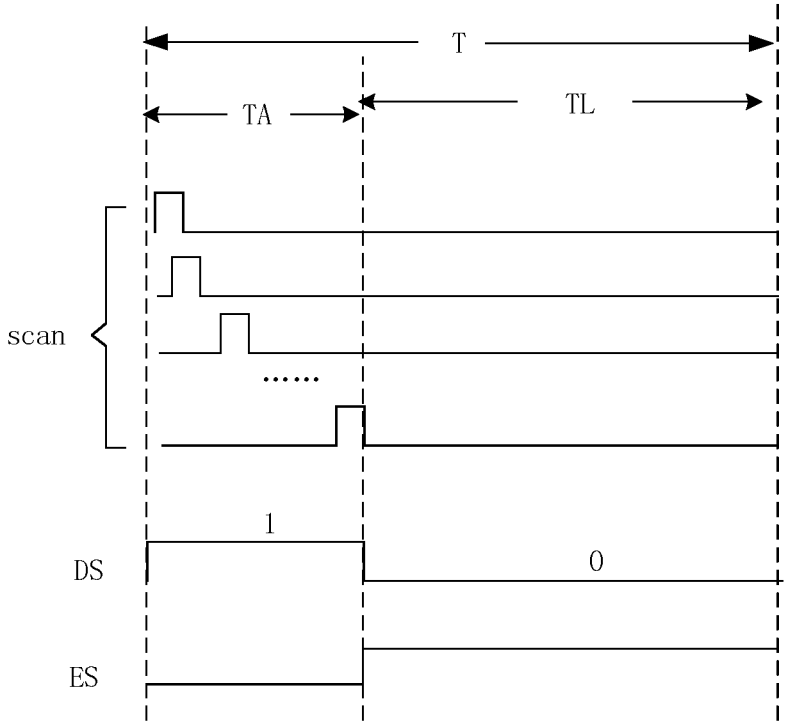
FIG. 2 is a timing diagram of a pixel driving circuit according to an embodiment of the present invention.

Please refer to FIG. 1 and FIG. 2. FIG. 2 is a timing diagram of a pixel driving circuit according to an embodiment of the present invention. The digital signal controller Ctr provides the digital signal DS of a predetermined addressing period TA. The digital signal DS and the current signal ES are both transferred to the anode of the lighting unit M such that the current signal ES has a predetermined display period and the lighting unit M generates light in the predetermined display period TL. Further, the luminance of the lighting unit M in the predetermined addressing period TA is weaker than the luminance of the lighting unit M in the predetermined display period TL.

The predetermined addressing period TA and the predetermined display period TL constitute a predetermined period T of the predetermined frame such that the lighting unit M could constitute the predetermined frame.

The pixel driving circuit 10 further comprises a plurality of vertical data lines and a plurality of horizontal scan lines. The data lines provide a data signal data to the source s of the addressing transistor T1. The scan line provides the scan signal scan to the gate g of the addressing transistor T1 such that the drain d of the addressing transistor T1 provides a current signal ES to the storage capacitor Cst.

In this embodiment, through providing a digital signal controller Ctr and one or more lighting units M at the drain d of the driving transistor T2 of the pixel driving circuit, the digital signal controller Ctr provides a digital signal DS of the addressing period TA to the lighting unit M. The digital signal DS, the scan signal scan, the power positive voltage Vss and the power negative voltage Vdd all act on the driving transistor Ts to form the current signal RS of the drain d of the driving transistor T2 in the predetermined display period TL. This make the addressing period TA and the predetermined display period TL constitute the predetermined period T of the predetermined frame such that the pixel unit L has the predetermined period T of the predetermined frame and the lighting unit M could periodically generates light.

The theory for the pixel driving circuit 10 to periodically generate light is as below:

The scan signal scan comprises a high voltage impulse and a low voltage impulse. The scan signal scan varies to control the on/off condition of the addressing transistor T1.

When the scan signal scan is a high voltage impulse, the addressing transistor is turned on. The gate g of the first transistor T1 receives the scan signal scan. The storage capacitor Cst stores the scan signal scan and transforms the scan signal scan to the corresponding current signal ES.

When the scan signal scan is a low voltage impulse, the addressing transistor T1 is turned off. The storage capacitor Cst provides the current signal ES to the gate g of the driving transistor T2. When the current value of the current signal ES reaches the current threshold of the driving transistor TS, the driving transistor T2 is turned on such that the lighting unit M generates light.

In FIG. 2, the scan signal scan, the digital signal data, and the current signal ES are superposed to indicate the predetermined addressing period TA and the predetermined display period TL in the predetermined period T.

In the predetermined addressing period TA, the scan signal scan is a high voltage impulse, the current signal ES corresponds to a low voltage level and the digital signal DS corresponds to a logic high level. At this time, the lighting unit M of the pixel driving circuit 10 generates light.

In the predetermined display period TL, the scan signal scan is a low voltage impulse, the current signal ES corresponds to a high voltage level and the digital signal DS corresponds to a logic low level. At this time, the lighting unit M of the pixel driving circuit 10 generates light.

The above embodiments explain how the pixel driving circuit 10 could periodically generate light. Then, the time-division multiplexing and the spatial multiplexing mechanisms of the pixel driving circuit 10 will be illustrated.

Please refer to FIG. 3. FIG. 3 is a diagram of a pixel driving circuit 11 according to another embodiment of the present invention. The pixel driving circuit 11 has the spatial multiplexing mechanism on the basis of the pixel driving circuit 10 shown in FIG. 1.

In the pixel driving circuit 11, the number of the pixel units L is one or more and the pixel units L are connected in parallel at the drain d of the driving transistor T2. The pixel units L comprise a first pixel unit L1 and a second pixel unit L2. The first pixel unit L1 comprises a first digital signal controller Ctr1 and a lighting unit M1. The first digital signal controller Ctr1 is connected to the anode of the lighting unit M1.

The second pixel unit L2 comprises a second digital signal controller Ctr2 and further comprises two lighting units M2 connected in parallel. The second digital signal controller Ctr2 is connected to the anodes of the two lighting units M2 such that the luminance of the second pixel unit L2 is double of the luminance of the first pixel unit L1 in the predetermined frame.

In the timing diagram of FIG. 2, for one pixel unit L, the predetermined display period TL is double of the predetermined addressing period TA in a predetermined period T. Therefore, when the first digital signal controller Ctr1 is turned on and the second digital signal controller Ctr2 is turned off, then 2×2=4 different grey levels could be displayed. When the first digital signal controller Ctr1 and the second digital signal controller Ctr2 are working at the same time, then the first pixel unit L1 and the second pixel unit L2 could work together to display 10 different grey scales. The implementation is shown in the table 1 below:

TABLE 1

| L1 | | L2 | | |
|---|---|---|---|---|
| TA | TL | TA | TL | Grey level |
| 0 | 0 | 0 | 0 | 0 |
| 0 | 1 | 0 | 0 | 1 |
| 1 | 0 | 0 | 0 | 2 |
| 1 | 1 | 0 | 0 | 3 |
| 0 | 0 | 1 | 0 | 4 |

TABLE 1-continued

| L1 | | L2 | | |
|---|---|---|---|---|
| TA | TL | TA | TL | Grey level |
| 0 | 1 | 1 | 0 | 5 |
| 0 | 0 | 1 | 1 | 6 |
| 0 | 1 | 1 | 1 | 7 |
| 1 | 0 | 1 | 1 | 8 |
| 1 | 1 | 1 | 1 | 9 |

From the above, in the pixel driving circuit 11, the predetermined display period TL is double of the predetermined addressing period TA in a predetermined period T. Therefore, for a pixel unit L, the amount of light generated by the lighting unit M in the predetermined display period TL is double of the amount of light generated by the lighting unit M in the predetermined addressing period TA. For example, assuming that in the first pixel unit L1, the grey level corresponding to the predetermined addressing period TA is 1, the grey level corresponding to the predetermined display period TA is 2. Further, because the luminance of the second pixel unit L2 is double of the luminance of the first pixel unit L1, in the second pixel unit L2, the grey level corresponding to the predetermined addressing period TA is 2, the grey level corresponding to the predetermined display period TA is 4.

Therefore, in the pixel driving circuit 11, when the overall grey level is 9, this grey level could be realized by turning on the first digital signal controller Ctr1 and the second digital signal controller Ctr2 such that the grey level is $1\times1+1\times2+1\times2+1\times4=9$. In this way, the pixel driving circuit 11 could realize 9+1=10 different grey levels.

In the pixel driving circuit 11, only another one second pixel unit L2 is adopted. Further, the two parallel-connected lighting units M2 are used with the second digital controller Ctr2 such that multiple grey levels could be displayed. The pixel driving circuit 11 could reduce the occupied space of the pixel unit L and the signal switching frequency of the gate of the transistor while realizing displaying the multiple grey levels.

In another embodiment, the number of the pixel unit L is not limited to two. Please refer to FIG. 4. FIG. 4 is a diagram of a pixel driving circuit 12 according to another embodiment of the present invention.

In the pixel driving circuit 12, the pixel units L are connected in parallel. The pixel unit L further comprises a third pixel unit L3. The third pixel unit L3 and the second pixel unit L2 are connected in parallel.

The third pixel unit L3 comprises a third digital signal controller Ctr3. The third digital signal controller Ctr3 is electrically connected to anodes of a predetermined number of lighting units M3. The predetermined number of lighting units M3 are connected in parallel. The predetermined number is an odd number times of the number of the lighting units L2 of the second pixel unit L2 such that the luminance of the third pixel unit L3 is the odd number times of the luminance of the second pixel unit L2. For example, from the above, it could be understood that the predetermined display period TL is double of the predetermined addressing period TA. Assuming that the number of the lighting units in the third pixel unit L3 is 4, the luminance (grey level) of the third pixel unit L3 should be double of that of the second pixel unit L2. The actual implementation is shown in table 2 below:

TABLE 2

| L1 | | L2 | | L3 | | |
|---|---|---|---|---|---|---|
| TA(1) | TL(2) | TA(2) | TL(4) | TA(4) | TL(8) | Grey level |
| 0 | 0 | 0 | 0 | 0 | 0 | 0 |
| 1 | 0 | 0 | 0 | 0 | 0 | 1 |
| 0 | 1 | 0 | 0 | 0 | 0 | 2 |
| 1 | 1 | 0 | 0 | 0 | 0 | 3 |
| 0 | 1 | 1 | 0 | 0 | 0 | 4 |
| 1 | 1 | 1 | 0 | 0 | 0 | 5 |
| 0 | 1 | 0 | 1 | 0 | 0 | 6 |
| 1 | 1 | 0 | 1 | 0 | 0 | 7 |
| 0 | 1 | 1 | 1 | 0 | 0 | 8 |
| 1 | 1 | 1 | 1 | 0 | 0 | 9 |
| 0 | 1 | 0 | 1 | 1 | 0 | 10 |
| 1 | 1 | 0 | 1 | 1 | 0 | 11 |
| 0 | 1 | 1 | 1 | 1 | 0 | 12 |
| 1 | 1 | 1 | 1 | 1 | 0 | 13 |
| 0 | 1 | 0 | 0 | 1 | 1 | 14 |
| 1 | 1 | 0 | 0 | 1 | 1 | 15 |
| 0 | 1 | 1 | 1 | 0 | 1 | 16 |
| 1 | 1 | 1 | 1 | 0 | 1 | 17 |
| 0 | 1 | 1 | 1 | 0 | 1 | 18 |
| 1 | 1 | 1 | 1 | 0 | 1 | 19 |
| 0 | 1 | 1 | 1 | 1 | 1 | 20 |
| 1 | 1 | 1 | 1 | 1 | 1 | 21 |

When the first digital signal controller Ctr1, the second digital signal controller Ctr2 and the third digital signal controller Ctr3 are all turned on, then the overall grey levels could be $1\times1+1\times2+1\times2+1\times4+1\times4+1\times8=21$. Therefore, the pixel driving circuit 12 could realize 22 grey levels.

In some embodiments, the digital signal controller Ctr is connected to an external timing controller (not shown). The predetermined addressing period TA and the predetermined display period could be provided by the timing controller.

The addressing transistor T1 and the driving transistor T2 could be both implemented with a low temperature poly silicon (LTPS) thin film transistor (TFT), a oxide-semiconductor TFT, or an amorphous silicon TFT. The digital signal controller could be implemented with a low temperature poly silicon (LTPS) thin film transistor (TFT), an oxide-semiconductor TFT, or an amorphous silicon TFT.

Further, according to an embodiment of the present invention, a display device is provided. The display device comprises the above-mentioned pixel driving circuit in any one of the above-mentioned embodiments. The display device could be a cell phone, a laptop, a TV, a display, a tablet, a digital frame, a navigator, or any other devices or components having display functions.

An embodiment of the present invention adds one or more digital signal controllers to control the lighting units to periodically generate light such that the spatial multiplexing mechanism and the time-division multiplexing mechanism are both used. This solves the issues of high switching frequency or larger display region.

One of ordinary skill in the art may make variations, modifications, substitutions and alterations to the above embodiments within the scope of the present disclosure.

Above are embodiments of the present invention, which does not limit the scope of the present invention. Any modifications, equivalent replacements or improvements within the spirit and principles of the embodiment described above should be covered by the protected scope of the invention.

What is claimed is:

1. A pixel driving circuit, comprising:

an addressing transistor;

a driving transistor;

a storage capacitor; and a plurality of pixel units connected in parallel;

wherein a drain of the addressing transistor is electrically connected to a gate of the driving transistor;

wherein a first end of the storage capacitor is connected to the gate of the driving transistor and a second end of the storage capacitor is connected to a drain of the driving transistor;

wherein the pixel units are connected to the drain of the driving transistor, the pixel units comprise at least one digital signal controller, and the digital signal controller is series connected to a plurality of lighting units; and wherein the gate of the addressing transistor receives a scan signal, the digital signal controller provides a digital signal, the scan signal and the digital signal makes the lighting units periodically generate lights such that a predetermined frame is displayed, wherein a source of the driving transistor receives a positive power voltage, a cathode of the lighting units receives a negative power voltage, the scan signal, the positive power voltage and the negative power voltage together act on the driving transistor to form a current signal of the drain of the driving transistor; wherein the digital signal controller provides the digital signal having a predetermined addressing period, the digital signal and the current signal are both transferred to an anode of the lighting units such that the current signal has a predetermined display period and the lighting units generates light in the predetermined display period; and wherein the predetermined addressing period and the predetermined display period constitute a predetermined period of the predetermined frame such that the lighting units constitute the predetermined frame.

2. The pixel driving circuit of claim 1, wherein when the scan signal corresponds to a high impulse, the addressing transistor is turned on, the gate of the addressing gate receives the scan signal, and the storage capacitor stores the scan signal and transform the scan signal into a corresponding current signal; and wherein when the scan signal corresponds to a low impulse, the addressing transistor is turned off, the storage capacitor provides the current signal to the gate of the driving transistor, and when a current value of the current signal reaches a current threshold of the driving transistor, the driving transistor is turned on and the lighting units generate light.

3. The pixel driving circuit of claim 1, wherein the scan signal, the digital signal, and the current signal are superposed to indicate the predetermined addressing period and the predetermined display period in the predetermined period; wherein in the predetermined addressing period, the scan signal is a high voltage impulse, the current signal corresponds to a low voltage level and the digital signal corresponds to a logic high level; and wherein in the predetermined display period, the scan signal is a low voltage impulse, the current signal corresponds to a high voltage level and the digital signal corresponds to a logic low level.

4. The pixel driving circuit of claim 1, wherein in one of the pixel units, the predetermined display period is double of the predetermined addressing period in one predetermined period.

5. The pixel driving circuit of claim 1, wherein the pixel units comprise a first pixel unit and a second pixel unit, the first pixel unit comprises a first digital signal controller and a lighting unit, and the first digital signal controller is electrically connected to an anode of the lighting unit; and wherein the second pixel unit comprises a second digital signal controller and two lighting unit connected in parallel, the second digital signal controller is electrically connected to anodes of the two lighting units connected in parallel to make a luminance of the second pixel unit be double of a luminance of the first pixel unit.

6. The pixel driving circuit of claim 5, wherein the pixel units further comprise a third pixel unit, connected to the second pixel unit in parallel; and wherein the third pixel unit comprises a third digital signal controller, the third digital signal controller is electrically connected to anodes of a predetermined number of lighting units, the predetermined number of lighting units are connected in parallel, the predetermined number is an odd number times of a number of the lighting units of the second pixel unit such that a luminance of the third pixel unit is the odd number times of the luminance of the second pixel unit.

7. The pixel driving circuit of claim 1, further comprising a plurality of vertical data lines and a plurality of horizontal scan lines, the data lines provide a data signal to a source of the addressing transistor, and the scan line provides the scan signal to the gate of the addressing transistor such that the drain of the addressing transistor provides a current signal to the storage capacitor.

8. The pixel driving circuit of claim 1, wherein the digital signal controller is implemented with a low temperature poly silicon (LTPS) TFT, an oxide-semiconductor TFT, or an amorphous silicon TFT.

9. A display device comprising a pixel driving circuit, the pixel driving circuit comprising:

an addressing transistor;

a driving transistor;

a storage capacitor; and a plurality of pixel units connected in parallel;

wherein a drain of the addressing transistor is electrically connected to a gate of the driving transistor;

wherein a first end of the storage capacitor is connected to the gate of the driving transistor and a second end of the storage capacitor is connected to a drain of the driving transistor;

wherein the pixel units are connected to the drain of the driving transistor, the pixel units comprise at least one digital signal controller, and the digital signal controller is series connected to a plurality of lighting units; and wherein the gate of the addressing transistor receives a scan signal, the digital signal controller provides a digital signal, the scan signal and the digital signal makes the lighting units periodically generate lights such that a predetermined frame is displayed, wherein the pixel units comprise a first pixel unit and a second pixel unit, the first pixel unit comprises a first digital signal controller and a lighting unit, and the first digital signal controller is electrically connected to an anode of the lighting unit; and wherein the second pixel unit comprises a second digital signal controller and two lighting unit connected in parallel, the second digital signal controller is electrically connected to anodes of the two lighting units connected in parallel to make a luminance of the second pixel unit be double of a luminance of the first pixel unit.

10. The display device of claim 9, wherein a source of the driving transistor receives a positive power voltage, a cathode of the lighting units receives a negative power voltage, the scan signal, the positive power voltage and the negative power voltage together act on the driving transistor to form a current signal of the drain of the driving transistor; wherein the digital signal controller provides the digital signal having a predetermined addressing period, the digital signal and the current signal are both transferred to an anode of the lighting units such that the current signal has a predetermined display period and the lighting units generates light in the predetermined display period; and wherein the predetermined addressing period and the predetermined display period constitute a predetermined period of the predetermined frame such that the lighting units constitute the predetermined frame.

11. The display device of claim 10, wherein when the scan signal corresponds to a high impulse, the addressing transistor is turned on, the gate of the addressing gate receives the scan signal, and the storage capacitor stores the scan signal and transform the scan signal into a corresponding current signal; and wherein when the scan signal corresponds to a low impulse, the addressing transistor is turned off, the storage capacitor provides the current signal to the gate of the driving transistor, and when a current value of the current signal reaches a current threshold of the driving transistor, the driving transistor is turned on and the lighting units generate light.

12. The display device of claim 10, wherein the scan signal, the digital signal, and the current signal are superposed to indicate the predetermined addressing period and the predetermined display period in the predetermined period; wherein in the predetermined addressing period, the scan signal is a high voltage impulse, the current signal corresponds to a low voltage level and the digital signal corresponds to a logic high level; and wherein in the predetermined display period, the scan signal is a low voltage impulse, the current signal corresponds to a high voltage level and the digital signal corresponds to a logic low level.

13. The display device of claim 10, wherein in one of the pixel units, the predetermined display period is double of the predetermined addressing period in one predetermined period.

14. The display device of claim 9, wherein the pixel units further comprise a third pixel unit, connected to the second pixel unit in parallel; and wherein the third pixel unit comprises a third digital signal controller, the third digital signal controller is electrically connected to anodes of a predetermined number of lighting units, the predetermined number of lighting units are connected in parallel, the predetermined number is an odd number times of a number of the lighting units of the second pixel unit such that a luminance of the third pixel unit is the odd number times of the luminance of the second pixel unit.

15. The display device of claim 9, wherein the pixel driving circuit further comprises a plurality of vertical data lines and a plurality of horizontal scan lines, the data lines provide a data signal to a source of the addressing transistor, and the scan line provides the scan signal to the gate of the addressing transistor such that the drain of the addressing transistor provides a current signal to the storage capacitor.

16. The display device of claim 9, wherein the digital signal controller is implemented with a low temperature poly silicon (LTPS) TFT, an oxide-semiconductor TFT, or an amorphous silicon TFT.

* * * * *